US008083097B2

(12) United States Patent
Kaufman

(10) Patent No.: US 8,083,097 B2
(45) Date of Patent: Dec. 27, 2011

(54) INTERLEAVED TOWEL FOLD CONFIGURATION

(75) Inventor: Kenneth Kaufman, Bradenton, FL (US)

(73) Assignee: Kimberly-Clark Worldwide, Inc, Neenah, WI (US)

( * ) Notice: Subject to any disclaimer, the term of this patent is extended or adjusted under 35 U.S.C. 154(b) by 969 days.

(21) Appl. No.: 10/955,685

(22) Filed: Sep. 30, 2004

(65) Prior Publication Data

US 2006/0102643 A1 May 18, 2006

(51) Int. Cl.
*A47K 10/24* (2006.01)

(52) U.S. Cl. ..... 221/48; 221/34

(58) Field of Classification Search ..... 221/38, 221/45, 49, 48; 270/39.06
See application file for complete search history.

(56) References Cited

U.S. PATENT DOCUMENTS

| | | | |
|---|---|---|---|
| 1,141,395 | A | 6/1915 | Johnston et al. |
| 1,222,261 | A | 4/1917 | Brown et al. |
| 1,228,400 | A | 6/1917 | Brown et al. |
| 1,256,334 | A | 2/1918 | Lazar |
| 1,347,262 | A | 7/1920 | Bartlett |
| 1,501,662 | A | 7/1924 | Horwitt |
| 1,675,700 | A | 7/1928 | Fairchild |
| 1,681,639 | A | 8/1928 | Hansen |
| 1,683,719 | A | 9/1928 | Harralson |
| 1,698,823 | A | 1/1929 | Rasmussen |
| 1,706,166 | A | 3/1929 | Hung |
| 1,886,312 | A | 11/1932 | Stanton |
| 1,962,762 | A | 6/1934 | Campbell |
| 1,989,381 | A | 1/1935 | Samson |
| 2,009,464 | A | 7/1935 | Winter |
| 2,244,630 | A | 6/1941 | Metternich |
| 2,440,993 | A | 5/1948 | West |
| 2,477,223 | A | 7/1949 | West |
| 3,007,605 | A | 11/1961 | Donovan |
| 3,047,141 | A | 7/1962 | Burns |
| 3,119,516 | A | 1/1964 | Donovan |
| 3,199,861 | A | 8/1965 | Presnell et al. |
| 3,207,361 | A | 9/1965 | Marcalus |
| 3,285,599 | A | 11/1966 | Pherson et al. |
| 3,291,477 | A | 12/1966 | Rehr |
| 3,291,478 | A | 12/1966 | Couzens et al. |
| 3,291,479 | A | 12/1966 | Greiner et al. |
| 3,462,043 | A | 8/1969 | Frick |
| 3,572,681 | A | 3/1971 | Nystrand |
| 3,845,948 | A | 11/1974 | Furbeck et al. |
| 3,980,289 | A | 9/1976 | Harm |

(Continued)

FOREIGN PATENT DOCUMENTS

| | | | |
|---|---|---|---|
| DE | 2353112 | A1 | 4/1975 |

(Continued)

*Primary Examiner* — Timothy Waggoner
(74) *Attorney, Agent, or Firm* — Nancy M. Klembus

(57) ABSTRACT

A stack of interleaved towels is provided wherein each towel is configured from a sheet of material having a first fold offset from a centerline of the sheet to generate a first panel folded toward a first surface of the sheet and extending between the first fold and a first end of the sheet. A second fold in the sheet is made substantially parallel to the first fold to create a second panel extending between the first and second folds and a third panel extending between the second fold and a second end of the sheet such that the first end of the sheet is positioned between the second and third panels. In the stack, the third panel of each towel is disposed adjacent the first panel of an adjacent towel such that the towels are interleaved.

20 Claims, 4 Drawing Sheets

U.S. PATENT DOCUMENTS

| | | | | | |
|---|---|---|---|---|---|
| 3,980,290 | A | | 9/1976 | Sjoman et al. | |
| 4,254,947 | A | | 3/1981 | Trogan | |
| 4,506,801 | A | * | 3/1985 | Origuchi | 221/26 |
| 4,548,595 | A | | 10/1985 | Heater et al. | |
| 4,623,074 | A | | 11/1986 | Dearwester | |
| 4,681,240 | A | | 7/1987 | Wyant | |
| 4,741,944 | A | | 5/1988 | Jackson et al. | |
| 4,859,518 | A | * | 8/1989 | Schutz | 428/126 |
| 4,865,221 | A | | 9/1989 | Jackson et al. | |
| 5,118,554 | A | * | 6/1992 | Chan et al. | 428/126 |
| 5,219,092 | A | | 6/1993 | Morand | |
| 5,332,118 | A | | 7/1994 | Muchenfuhs | |
| 5,540,332 | A | * | 7/1996 | Kopacz et al. | 206/494 |
| 5,565,258 | A | | 10/1996 | McConnell et al. | |
| 5,607,737 | A | * | 3/1997 | Blackwell et al. | 428/40.1 |
| 5,607,754 | A | | 3/1997 | Giles et al. | |
| 5,609,269 | A | | 3/1997 | Behnke et al. | |
| 5,642,835 | A | | 7/1997 | Young et al. | |
| 5,730,695 | A | | 3/1998 | Hauschild et al. | |
| 5,740,913 | A | * | 4/1998 | McFarland | 206/494 |
| 5,891,008 | A | | 4/1999 | Bavely et al. | |
| 5,899,447 | A | | 5/1999 | Muchenfuhs | |
| 5,964,351 | A | * | 10/1999 | Zander | 206/494 |
| 6,045,002 | A | * | 4/2000 | Wierschke | 221/48 |
| 6,090,467 | A | | 7/2000 | Yip | |
| 6,109,430 | A | * | 8/2000 | Bando et al. | 206/207 |
| 6,165,116 | A | * | 12/2000 | White | 493/360 |
| 6,168,848 | B1 | * | 1/2001 | Heath | 428/126 |
| 6,213,345 | B1 | | 4/2001 | Plank | |
| 6,213,346 | B1 | | 4/2001 | Skerrett et al. | |
| 6,238,328 | B1 | | 5/2001 | Loppnow et al. | |
| 6,296,143 | B1 | | 10/2001 | Ghabriel | |
| 6,306,480 | B1 | | 10/2001 | Yardley et al. | |
| 6,378,726 | B1 | | 4/2002 | Chan et al. | |
| 6,550,633 | B2 | * | 4/2003 | Huang et al. | 221/45 |
| 6,595,386 | B2 | * | 7/2003 | Vogel et al. | 221/48 |
| 6,623,833 | B2 | * | 9/2003 | Chan | 428/126 |
| 6,644,501 | B2 | | 11/2003 | Iida | |
| 6,672,475 | B1 | | 1/2004 | Ho et al. | |
| 6,685,050 | B2 | * | 2/2004 | Schmidt et al. | 221/48 |
| 6,730,012 | B2 | | 5/2004 | Bando | |
| 7,097,896 | B2 | * | 8/2006 | Merrill | 221/48 |
| 2002/0051863 | A1 | | 5/2002 | Chan | |
| 2002/0096534 | A1 | * | 7/2002 | Amundson et al. | 221/63 |
| 2002/0113109 | A1 | * | 8/2002 | Gracyalny et al. | 225/5 |
| 2003/0116581 | A1 | | 6/2003 | Schmidt et al. | |
| 2003/0178336 | A1 | * | 9/2003 | Zomorodi et al. | 206/494 |
| 2003/0183644 | A1 | * | 10/2003 | Sarnoff et al. | 221/48 |
| 2004/0007586 | A1 | * | 1/2004 | Boone et al. | 221/289 |

FOREIGN PATENT DOCUMENTS

| | | | |
|---|---|---|---|
| EP | 0747313 | A1 | 12/1996 |
| EP | 1136412 | A1 | 9/2001 |
| WO | WO 96/26664 | | 9/1996 |

* cited by examiner

INTERLEAVED TOWEL FOLD CONFIGURATION

BACKGROUND

Various fold configurations are well known for use in the sanitary sheet products (i.e., paper towels, tissues, napkins, etc.) art. In general, different fold configurations have been utilized to reduce dimensions of the dispensed products and/or to facilitate the dispensing process. Known fold configurations include basic C-fold, V-fold, Z-fold, M-fold, and numerous other single-ply or multi-ply configurations that may generally be referred to as "folded towels."

Typically, folded sheet towel products of the type dispensed in lavatories are stacked and banded together as a package for shipment and storage. For use, the stacked sheets are loaded into an appropriate dispenser. Adjacent sheets in the stack may be interleafed to promote the appearance of the next sheet in the opening of the dispenser after removal of a sheet. Often, due to the nature of the particular fold configuration, the stack of towels must be loaded with a specific orientation for proper grasping and dispensing by a subsequent user.

A primary and ongoing concern in the industry is to provide the user with a fold configuration that promotes efficient and non-wasteful dispensing and use of the towels.

One problem encountered with dispensing paper towels of conventional fold configurations is that the towels are typically folded and dispensed in a two-ply configuration that may provide more fiber per sheet than is necessary for efficient drying or that is not particularly amenable to being unfolded by the user into a larger single-ply sheet. The users may not unfold the towel and thus may perceive that the folded towel is not large enough to adequately dry their hands. After using one towel, the user will typically pull another towel to finish the drying process. This results in significant waste.

Thus, there exists a need in the art for an improved fold configuration for stacked towel products that provides efficient and non-wasteful dispensing of optimally sized towels that are readily unfolded and utilized by a user.

SUMMARY OF THE INVENTION

In accordance with the invention, a stack of interleaved towels is provided. Each towel is formed of a single sheet of material having a length and a width, typically a single-ply material. The towels according to the invention are not limited to any particular type of sheet material and may be formed of any absorbent material for use as a towel, wiper, napkin, or other stacked absorbent product. The sheet material may be, for example, a nonwoven, natural, or synthetic fiber material. Desirably, the sheet material is substantially rectangular in shape.

In one embodiment, each sheet of material includes a first fold in the sheet offset from a centerline of the sheet to create a folded sheet having a first panel folded toward a first surface of the sheet. The first panel extends between the first fold and a first end in the sheet. Each sheet of material further includes a second fold in the sheet substantially parallel to the first fold. The second fold creates a second panel extending between the first fold and the second fold such that the first fold presents a continuous folded leading edge for grasping by a user. The second fold further creates a third panel extending between the second fold and a second end of the sheet. The third panel is folded toward the first panel such that the first end of the sheet is positioned between the second and third panels. The third panel of each towel is disposed adjacent the first panel of an adjacent towel such that the sheets of material are interleaved.

In another embodiment, each sheet of material includes a first fold in the sheet offset from a centerline of the sheet to create a folded sheet having a long side and a short side. The short side has a length less than about 50 percent of the length of the long side. Each sheet of material includes a second fold in the sheet substantially parallel to the first fold. The second fold creates a two-ply lead flap and a single-ply trailing flap. The lead flap is defined between the first fold and the second fold such that the first fold presents a continuous folded leading edge for grasping by a user. The trailing flap is defined between the second fold and the end edge of the long side. The trailing flap at least partially covers the end edge of the short side. The trailing flap of each sheet of material is disposed between the lead flap and the trailing flap of an adjacent towel such that the towels are interleaved.

In a further embodiment, each sheet of material includes a first fold in the sheet offset from a centerline of the sheet to create a folded sheet having a first panel folded toward a first surface of the sheet and extending between the first fold and a first end in the sheet. Each sheet of material includes a second fold in the sheet substantially parallel to the first fold. The second fold creates a second panel extending between the first fold and the second fold such that the first fold presents a continuous folded leading edge for grasping by a user. The second fold further creates a third panel extending between the second fold and a second end of the sheet. The third panel is folded toward the first panel such that the first end of the sheet is positioned between the second and third panels. The first and second panels form a lead flap for grasping by a user. The third panel of each towel is disposed directly adjacent and between the lead flaps of the next two adjacent towels such that the sheets of material are interleaved. In one aspect, the next two adjacent towels may be the next two upper adjacent towels.

DETAILED DESCRIPTION

Figure 1:
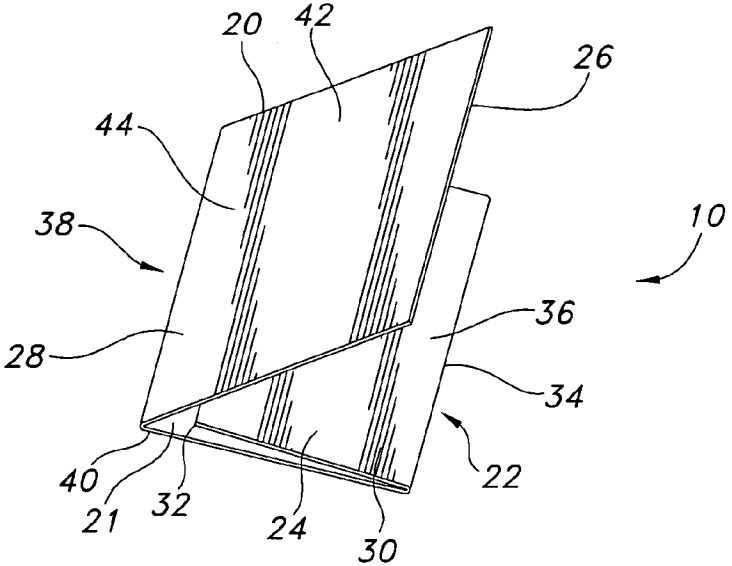
FIG. 1 is a perspective view of a single towel folded into a towel configuration of the present invention.

Reference will now be made in detail to embodiments of the invention, one or more examples of which are shown in the drawings. Each embodiment is presented by way of explaining the invention, and is not meant as a limitation of the invention. For example, features illustrated or described as part of one embodiment may be used with another embodiment to create still further embodiments. It is intended that the present invention include such modifications and variations.

Referring to FIG. 1, there is shown a single towel 10 folded into the towel fold configuration of the present invention. The single sheet employed for the towel 10 is desirably single-ply but may be multi-ply. In addition, the invention is not limited to any particular type of material, and includes any known material for forming absorbent products such as towels, wipes, napkins, and the like. The single sheets are desirably substantially rectangular in shape.

In the embodiment shown, a single sheet 20 having a first surface 21 is folded along a first fold line 22 across the width of the single sheet to create a folded or lead edge 34 and a first panel 24 extending from the lead edge. Generally, the fold line 22 extends in the cross-direction of the sheet 20 such that the towel 10 is dispensed in the machine direction. The single sheet 20 also has a trailing edge 26 that is formed by an end of the towel 10. The first fold line 22 is offset from a centerline of the single sheet 20 so that a long side 28 and a short side 30 corresponding to the first panel 24 are generated. In other words, the single sheet 20 is not folded in half. The length of the short side 30 may be less than half the length of the long side 28. Desirably, however, the length of the short side 30 is about half the length of the long side 28 or approximately one-third the total length of the single sheet 20. The lengths are measured with respect to the direction perpendicular to the first fold line. The long side 28 has an end edge 26 and the short side 30 has an end edge 32.

A second fold line 38 is imparted to the long side 28 of the single sheet 20 substantially parallel to the first fold line 22. The second fold line 38, which is desirably a one-ply fold of the single-ply sheet material 20, thereby creates a second panel 40 extending between the first and second fold lines 22, 38, and a third panel 42 extending between the second fold line and the end of the towel 26. Both the first and second fold lines 22, 38 are positioned on the same surface 21 of the single sheet 20. Put another way, the direction of the second fold 38 is such that the end 32 of the first panel 24 is positioned between the second and third panels 40, 42. Desirably, the first, second, and third panels 24, 40, 42 are substantially equal in length and thus substantially divide the sheet material 20 into thirds. However, it is contemplated that the lengths of the first, second, and third panels 24, 40, 42 may differ by a small amount, for example up to about 15 percent, to facilitate folding, dispensing, and/or unfolding of the towels.

Figure 2:
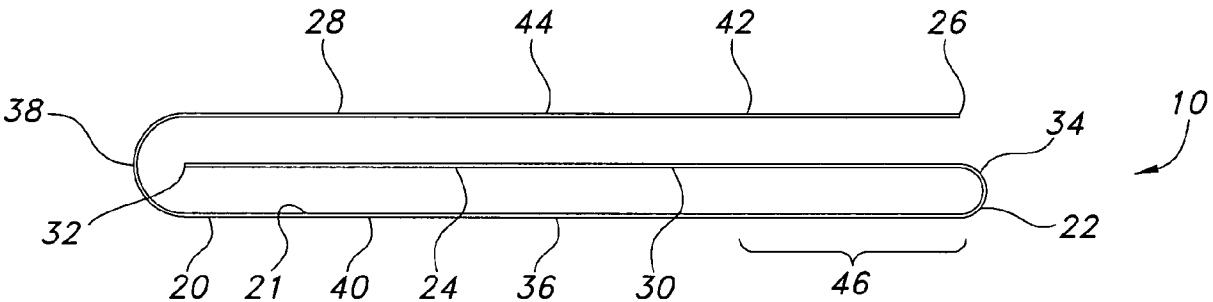
FIGS. 2 and 2A show an end schematic view of a towel folded in accordance with the configuration of FIG. 1.

The second fold line 38 also creates a lead flap 36 and a trailing flap 44. The lead flap 36 is defined between the first fold line 22 and the second fold line 38. The lead flap 36 is two-ply as a result of the first fold line 22 that created the folded or lead edge 34. The lead flap 36 has a two-ply tab 46 running the width of the towel 10 having the lead edge 34 that is folded as shown most clearly in FIG. 2. Desirably, the two-ply tab 46 extends substantially the entire length of the lead flap 36. The lead edge 34 is the leading portion of the lead flap 36 that extends through a dispensing slot or opening 18 of a dispenser 16 for grasping by a user, as particularly seen in FIG. 4. It is desirable that the user be presented with a two-ply lead flap 36 to reduce tearing of the towel 10 upon dispensing thereof. The force exerted by the user in pulling the towel 10 is transmitted through both plies of the lead flap 36, thereby minimizing tabbing failures. Tabbing failures occur where a user with wet hands grasps the towel to be dispensed, for example, between thumb and forefinger. As the user pulls on a small section of towel, which is now wet, it may fail such that the user is left with a small "tab" of towel between his thumb and forefinger with the remainder of the towel remaining in the dispenser.

Figure 2A:
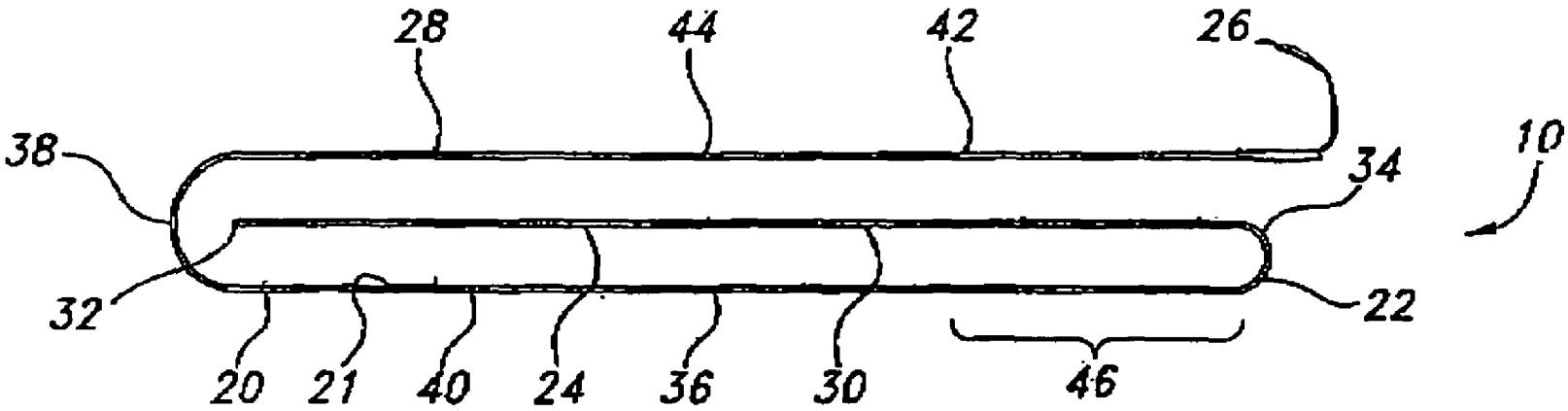

The trailing flap 44 is defined between the second fold line 38 and the trailing edge 26. Desirably the trailing flap 44 is a single ply. The trailing flap 44 may be longer than the lead flap 36, as is shown in FIG. 2A. Alternatively, the trailing flap 44 may be shorter than the lead flap 36, however, the trailing flap 44 and the lead flap are desirably substantially the same length.

The overall length of the single sheet 20 is desirably less than about 160 percent of the overall width of the single sheet, more desirably less than about 140 percent of the overall width of the single sheet, and even more desirably less than about 120 percent of the overall width of the single sheet. In one embodiment, the overall length of the single sheet 20 is substantially equal to the overall width of the single sheet. That is, after the first fold line 22 is created, the length of the long side 28 plus the length of the short side 30 is substantially equal to the width of the single sheet 20, the width corresponding to the length of the first fold line. As one example, the single sheet 20 may be from about 9 to about 10 inches long and from about 9 to about 10 inches wide. As another example, the single sheet 20 may be about 9.4 inches long and about 9.25 inches wide. After folding, the length of the folded towel would desirably be reduced to from about 3.1 to about 3.4 inches, more desirably to about 3.2 inches, while the width would remain at about 9.25 inches wide.

Figure 3:
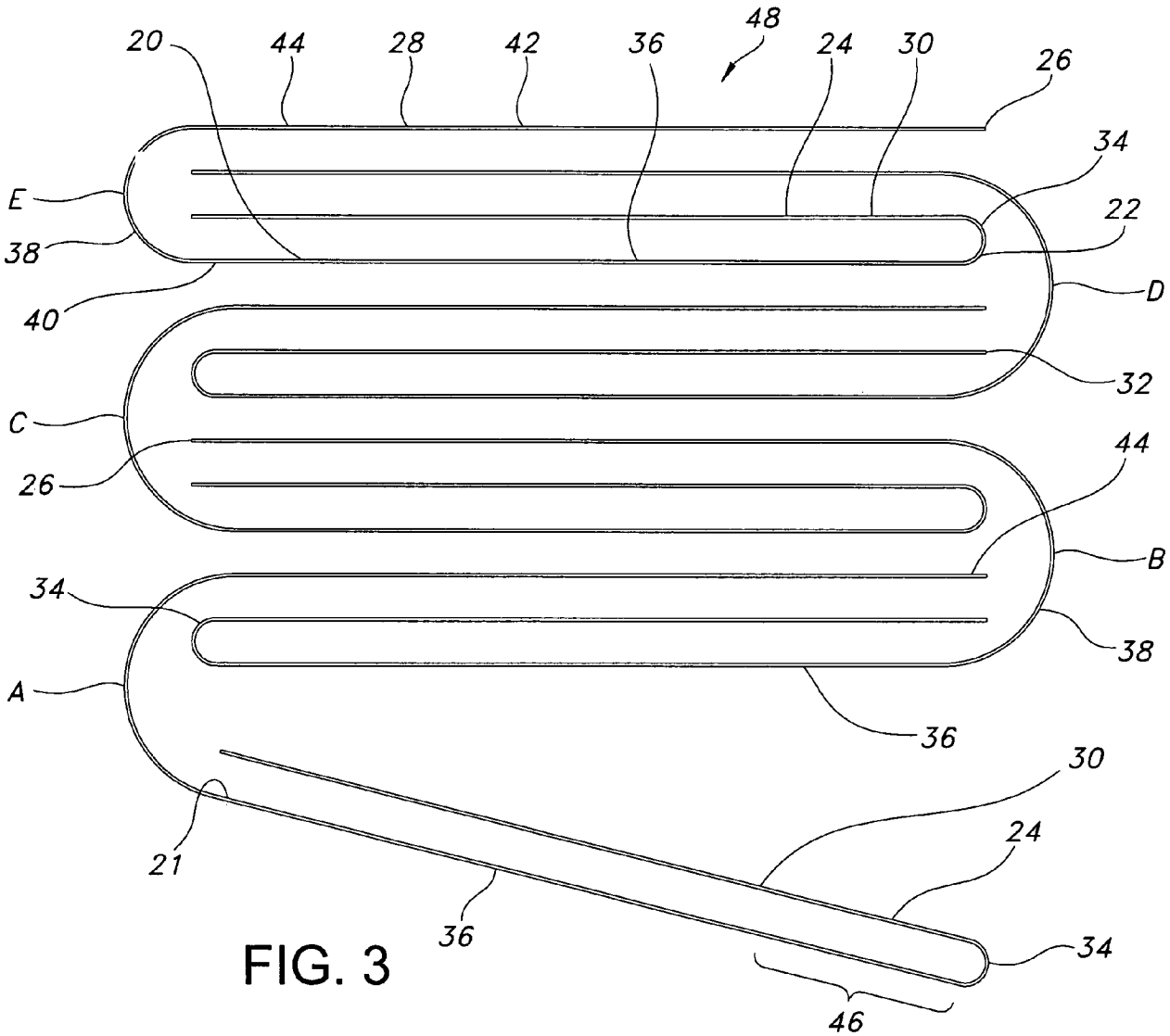
FIG. 3 is an end schematic view of an interleaved stack of towels of the present invention.
Figure 4:
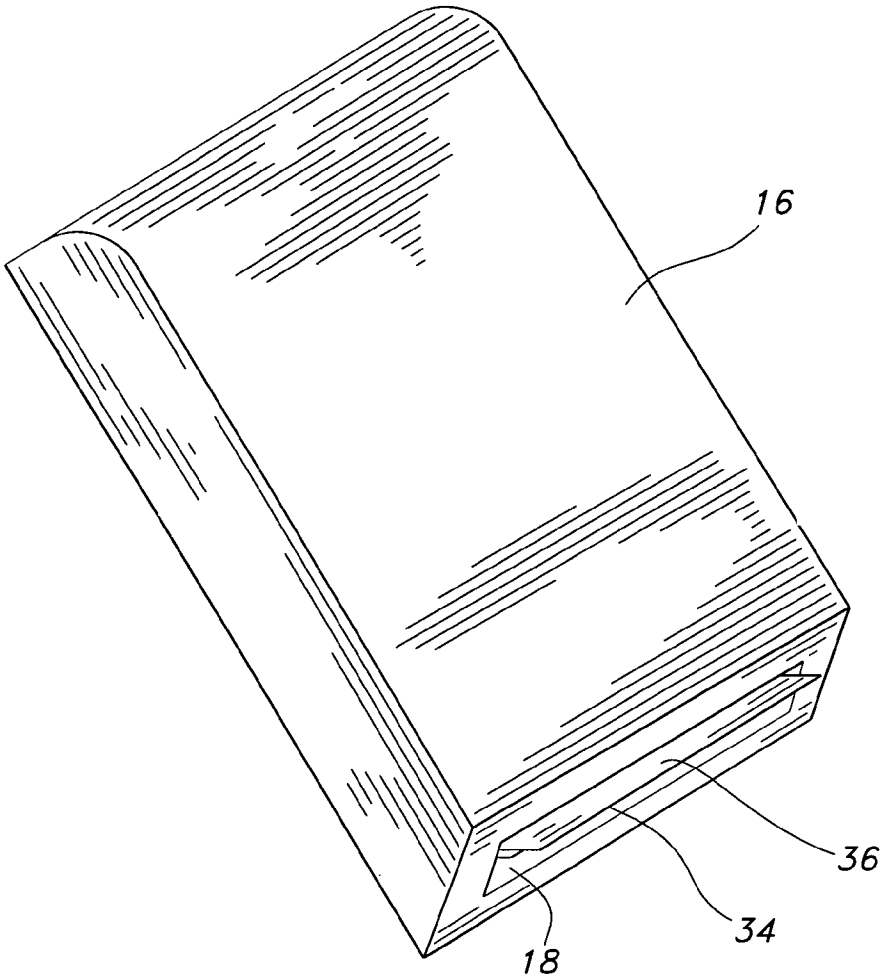
FIG. 4 is a perspective view of a conventional towel dispenser with the lead flap of a single towel extending through the dispensing opening.

Looking next at FIG. 3, there is shown a schematic end view of a stack 48 of five towels 10 of the fold configuration of the present invention. In practice, the stack 48 would desirably include from about 75 to about 350 towels 10. For purposes of clarity, the five towels 10 depicted in FIG. 3 are labeled A, B, C, D and E. The towels 10 are arranged in the stack 48 such that the lead flap 36 of towel A will extend through the dispensing opening or slot 18 in the dispenser 16, as illustrated in FIG. 4. The trailing flap 44 of each towel 10 is disposed between the lead flap 36 and the trailing flap 44 of an adjacent sheet of material such that the sheets of material are interleaved. While the trailing flap 44 of each towel 10 is disposed between the lead flap 36 and the trailing flap 44 of the next adjacent towel after interleaving, the trailing flap 44 of each towel 10 is also disposed directly adjacent and between the lead flaps 36 of the next two adjacent towels.

Walking through the dispensing of a few of the towels 10 of stack 48 will illustrate a number of advantages of the present invention. Assuming that the lead edge 34 of towel A is extending through the dispensing opening of a dispenser, the user grasps towel A typically somewhere along tab end 46. As the user pulls towel A through the dispensing opening, the tail or trailing flap 44 of towel A drags the lead flap 36 of towel B through the dispensing opening, ready for dispensing next. Because the lead flap 36 is substantially the same length as the trailing flap 44, the frictional forces between the trailing flap of towel A and the lead flap of towel B reduce the chance that the trailing flap of towel A could be withdrawn while leaving the lead flap of towel B inside the dispenser. Further, because the lead flap 36 is substantially the same length as the trailing flap 44, the leading edge 34 of the towel 10 next to be dispensed extends a further distance through the dispensing opening of the dispenser than would a shorter lead flap. As such, the user can grasp a greater portion of the lead flap, thus spreading the force required to withdraw the towel 10 over a greater surface area of the towel. It is believed that this distribution of forces minimizes the incidence rate of tear-out and tab-out failure of the dispensing of towel A. The user may now grab the tab end 46 of towel B causing it to be dispensed. As towel B is dispensed, the lead flap 36 of towel C is pulled through the dispensing opening of the dispenser.

As towel A of FIG. 3 is being dispensed, the lead flap 36 of towel C provides support to towel B to prevent multiple dispensing wherein towel B would be dragged through the dispensing opening simultaneously with towel A, thus creating potential waste. The support provided by the lead flap 36 of towel C in retaining towel B is given added rigidity due to the fact that lead flap 36 is double-ply. Thus it can be seen that the towel fold configuration of the present invention provides a double-ply lead flap to reduce tab-out and tear-out of the towel 10 upon dispensing and provides sufficient support to the towel 10 next to be dispensed to prevent multiple dispensing, yet also provides a single-ply trailing flap to reduce the total quantity of fiber provided in the towel.

The two-ply lead flap 36 of the towel 10 next to be dispensed provides an advantage even over a typical laminated two-ply V-fold towel. It is known that laminated two-ply towels can delaminate. Delamination can occur at the dispensing opening as a result of the forces imparted on the lead end of such an interleaved, laminated two-ply towel when it is dragged through the dispensing opening of a dispenser by the trailing flap of the towel immediately preceding it. Delamination in such manner may present to the user two (2) lead flaps. If the user grasps a single ply of the two-ply sheet, it is likely to result in a tear-out or tab-out failure of dispensing, particularly if the user's hands are wet. Because the two-ply nature of the towel 10 of the present invention is created by folding a single sheet, and because the tab end 46 is always at the folded or lead edge 34, the user will always be grasping a two-ply tab end 46. The force exerted by the user in dispensing a towel 10 is always transmitted through both plies thereby adding strength and minimizing tab-out failure.

It is known that superior water absorbency is achieved when paper towels are used in a two-ply configuration. The towel 10 of the present invention allows such usage even though it may be formed from a single-ply sheet. As the towel 10 is dispensed, the action of the trailing flap 44 in pulling the lead flap 36 of the towel next to be dispensed causes the towel 10 being dispensed to open at the second fold line 38. After dispensing, the towel as dispensed is substantially half two-ply and half single-ply. The user is thus presented with an option to use the towel 10 as presented or to unfold the first fold to obtain the maximum towel size. Depending on the user's needs, either option may be desirable.

The towel 10 of the present invention is desirably designed for use in a typical C-fold, V-fold, or M-fold dispenser such as depicted in FIG. 4. An exemplary dispenser is Scott Towel Dispenser No. 0995 that has inside dimensions of 3.8" by 10.6". The towel 10 desirably employs a sheet material that has a water capacity greater than about 2 grams of water per gram of sheet material, a machine direction absorbency rate of greater than about 1 centimeter per 15 seconds, a basis weight ranging from about 10 to about 150 grams per square meter, and a geometric mean tensile strength ranging from about 200 to about 2500 grams-force per 25.4 millimeters wide strip. More desirably, the basis weight ranges from about 20 to about 45 grams per square meter, and the geometric mean tensile strength ranges from about 800 to about 1700 grams-force per 25.4 millimeters wide strip. Generally, a towel having a basis weight of 30 grams per square meter and a geometric mean tensile strength of about 1150 grams-force per 25.4 millimeters wide strip is even more desirable.

As used herein, water capacity is a measure of the quantity of water absorbed per grams of fiber in the towel as used. Machine direction absorbency rate is a measure of the distance water travels (cm) in the machine direction of the sheet in fifteen seconds. Basis weight is expressed in grams per square meter. Geometric mean tensile strength is a composite property equal to the square root of the tensile strength of the web in the machine direction multiplied by the tensile strength of the web in the cross machine direction in grams-force per 25.4 millimeter sample width.

As used herein and in the claims, the terms "comprising" and "including" are inclusive or open-ended and do not exclude additional unrecited elements, compositional components, or method steps. Accordingly, the terms "comprising" and "including" encompass the more restrictive terms "consisting essentially of" and "consisting of."

It should be appreciated by those skilled in the art that various modifications and variations can be made in the fold configuration according to the invention without departing from the scope and spirit of the invention. It is intended that the invention include such modifications and variations as come within the scope of the appended claims and their equivalents.

The invention claimed is:

1. A stack of interleaved towels, each towel of the stack comprises a sheet of material, said sheet comprises a first surface, a first end, a second end, a centerline, a first fold, a second fold, a first panel, a second panel, a third panel, a length and a width;

the first fold in the sheet is offset from the centerline; the first fold creating a folded sheet, the first fold creating the first panel which is folded towards the first surface of the sheet; the first panel extends between the first fold and a first end in the sheet;

the second fold in the sheet is substantially parallel to the first fold, the second fold creates the second panel, the second panel extends in between the first fold and the second fold and the second fold creates the third panel folded toward the first panel the third panel extends between the second fold and the second end of the sheet;

wherein the first end of each sheet is positioned between the second and third panels of that sheet such that the third panel overlaps the first end; and, wherein the third panel of each towel in the stack is disposed adjacent the first panel of an adjacent towel in the stack such that the towels are interleaved.

2. The stack of interleaved towels as in claim 1, wherein the sheet of material is a single-ply material.

3. The stack of interleaved towels as in claim 1, wherein the sheet of material is substantially rectangular in shape.

4. The stack of interleaved towels as in claim 1, wherein the overall length of the sheet of material is less than about 160 percent of the overall width of the sheet material.

5. The stack of interleaved towels as claimed in claim 1, wherein the second fold creates a two-ply lead flap, the two-ply lead flap comprises a first ply and a second ply, wherein the first ply comprises the first panel and the second ply comprises the second panel; and wherein when a given towel of the stack is adjacent two other towels of the stack, the third panel of the given towel of the stack is disposed directly adjacent and in between the lead flaps of the next two adjacent towels in the stack such that the towels are interleaved.

6. The stack of interleaved towels as in claim 5, wherein the sheet of material is a single-ply material.

7. The stack of interleaved towels as in claim 5, wherein the third panel creates a trailing flap and the lead flap is shorter than the trailing flap.

8. The stack of interleaved towels as in claim 5, wherein the third panel creates a trailing flap and the trailing flap is about the same length as the lead flap.

9. The stack of interleaved towels as in claim 5, wherein the sheet material is substantially rectangular in shape.

10. The stack of interleaved towels as in claim 5, wherein the overall length of the sheet material is less than about 160 percent of the overall width of the sheet material.

11. The stack of interleaved towels as in claim 5, wherein the overall length of the sheet material is substantially equal to the overall width of the sheet material.

12. The stack of interleaved towels as in claim 5, wherein each of the first panel, second panel and third panel have a length, the length of the first panel, the second panel and the third panel are substantially equal in length.

13. A stack of interleaved towels, each towel of the stack comprises a sheet of material, said sheet comprises a first surface, a first end, a second end, a centerline, a first fold, a second fold, a first panel, a second panel, a third panel, a length and a width;

the first fold in the sheet is offset from the centerline; the first fold creating a folded sheet, the first fold creating the first panel which is folded towards the first surface of the sheet; the first panel extends between the first fold and a first end in the sheet;

the second fold in the sheet is substantially parallel to the first fold, the second fold creates the second panel, the second panel extends between the first fold and the second fold and the second fold creates the third panel folded toward the first panel the third panel extends between the second fold and the second end of the sheet;

wherein the first end of each sheet is positioned in between the second and third panels of that sheet;

wherein each of the first panel, second panel and third panel have a length, the length of the first panel, the second panel and the third panel are substantially equal in length; and, wherein the third panel of each towel in the stack is disposed adjacent the first panel of an adjacent towel in the stack such that the towels are interleaved.

14. The stack of interleaved towels as claimed in claim 13, wherein the length of each of the first, second and third panels is within 15% of the length of the other panels.

15. The stack of interleaved towels as claimed in claim 13, wherein the second fold creates a two-ply lead flap, the two-ply lead flap comprises a first ply and a second ply, wherein the first ply comprises the first panel and the second ply comprises the second panel; and wherein when a given towel of the stack is adjacent two other towels of the stack, the third panel of the given towel of the stack is disposed directly adjacent and in between the lead flaps of the next two adjacent towels in the stack such that the towels are interleaved.

16. The stack of interleaved towels as in claim 15, wherein the sheet of material is a single-ply material.

17. The stack of interleaved towels as in claim 15, wherein the third panel creates a trailing flap and the lead flap is shorter than the trailing flap.

18. The stack of interleaved towels as in claim 15, wherein the third panel creates a trailing flap and the trailing flap is about the same length as the lead flap.

19. The stack of interleaved towels as in claim 15, wherein the sheet material is substantially rectangular in shape.

20. The stack of interleaved towels as in claim 15, wherein the overall length of the sheet material is less than about 160 percent of the overall width of the sheet material.

* * * * *